United States Patent [19]

Robinson

[11] B 3,986,410

[45] Oct. 19, 1976

[54] INDEXING MECHANISM

[75] Inventor: James H. Robinson, Elkhart, Ind.

[73] Assignee: CTS Corporation, Elkhart, Ind.

[22] Filed: May 15, 1974

[21] Appl. No.: 470,170

[44] Published under the second Trial Voluntary Protest Program on January 13, 1976 as document No. B 470,170.

[52] U.S. Cl. ..... 74/527; 74/10.41; 74/511 R; 200/291

[51] Int. Cl.[2] ..... G05G 5/06

[58] Field of Search ..... 74/10.41, 10.15, 10.1, 74/527, 511; 200/291, 327, 14

[56] References Cited

UNITED STATES PATENTS

| | | | |
|---|---|---|---|
| 2,130,219 | 9/1938 | Allison et al. | 74/527 |
| 2,292,717 | 8/1942 | Rubinstein | 74/527 |
| 2,770,982 | 11/1956 | Mastney et al. | 74/527 |
| 2,840,672 | 6/1958 | Martin | 74/527 |
| 3,230,793 | 1/1966 | Allison | 74/511 |
| 3,584,163 | 6/1971 | White | 200/291 |

*Primary Examiner*—Samuel Scott
*Assistant Examiner*—Randall Heald

[57] ABSTRACT

An indexing mechanism comprises a detent spring secured to a shaft and biased into engagement with a long wearing hill and valley insert secured to a housing. A variety of inserts can be secured to a standard housing providing a variety of switching positions and angles of indexing. A plurality of ears extending radially from the insert engage notches within the housing and a pair of spaced arms integral with each of the ears are biased against the walls of the notches to rigidly secure the insert to the housing. A stop element secured to the shaft is provided with a plurality of nubbins engaging a plurality of nubbin receiving notches provided in the detent spring for reinforcing the rotation of the detent spring in response to the rotation of the shaft.

12 Claims, 5 Drawing Figures

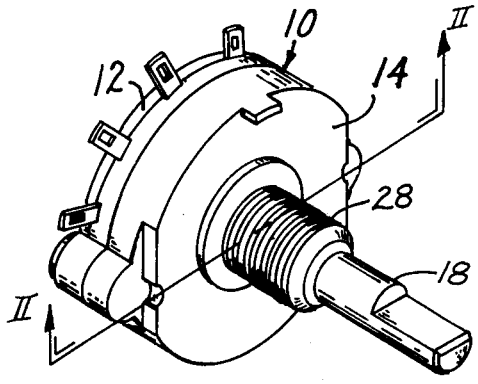
FIGURE- 1
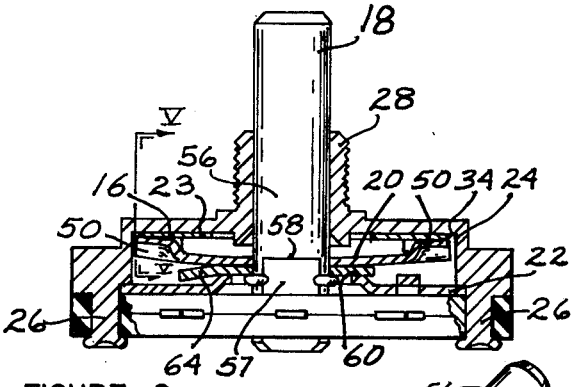
FIGURE- 2
FIGURE- 3
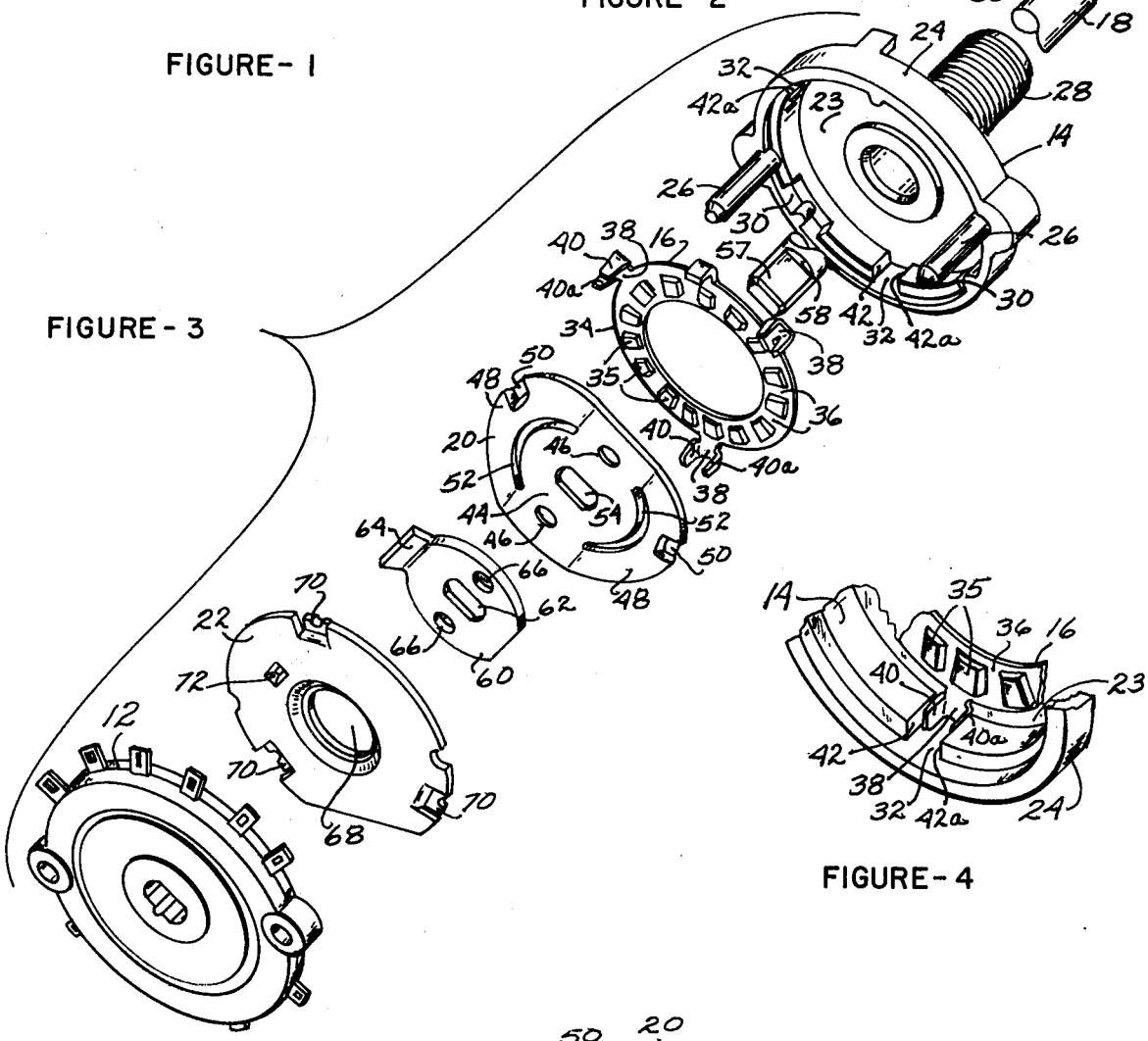
FIGURE- 4
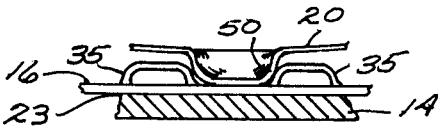
FIGURE- 5

INDEXING MECHANISM

The present invention relates to indexing mechanisms and more particularly to an indexing mechanism of the hill and valley detent type.

Angular positioning of a shaft of a selector switch generally depends upon an indexing mechanism, such as the indexing mechanisms disclosed in U.S. Pat. Nos. 3,230,793 and 3,584,163 providing a rotating shaft and a detent spring biased into engagement with a detent plate for switching the contacts of a switch wafer. However, selector switch applications often require indexing mechanisms providing a variety of positions and angles of indexing as well as providing a long mechanical life. A known method of providing different angles of indexing involves die casting or molding detent plates with a predetermined number of integral hills and valleys. However, die cast or molded materials generally do not have long life wear characteristics. On the other hand, detent plates made of materials such as stainless steel provide excellent wear characteristics and long life but generally are relatively uneconomical to produce and align with a switch wafer. In addition, a selector switch indexing mechanism generally is not readily adapted ot provide varying positions and angles of indexing since the detent plate usually forms an integral part of the housing or shaft assembly. In order to provide a variety of angles of indexing, it would be necessary to provide a variety of housings or shaft assemblies. It would therefore be desirable to provide a standard housing for an indexing mechanism for receiving a variety of long wearing hill and valley inserts providing various positions and angles of indexing as well as providing an indexing mechanism with an extended useful life.

In many indexing mechanisms, the shaft extends through an aperture in the detent spring and constrains the detent spring to rotate therewith in engagement with the detent plate. After a substantial number of rotations of the shaft, however, the bias of the detent spring against the detent plate and the wear of the shaft against the sides of the aperture often causes the detent spring to slip with respect to the shaft. Such slipping of the detent spring with respect to the shaft can result in irratic switching. It would therefore be desirable to provide a reinforcement means engaging the detent spring of an indexing mechanism to prevent slipping and to insure the movement of the detent spring in response to the rotation of the shaft.

Accordingly, it is an object of the present invention to provide a new and improved indexing mechanism for a selector switch providing an extended useful life and providing the means to vary the number of switching positions and angles of indexing.

Another object of the present invention is to provide a new and improved indexing mechanism having a standard housing for receiving a variety of long wearing hill and valley inserts.

A further object of the present invention is to provide an indexing mechanism having a hill and valley insert secured to the housing of the indexing mechanism.

Still another object of the present invention is to provide an indexing mechanism having a hill and valley insert with a radially extending ear engaging a notch in the housing of the indexing mechanism for interlocking the insert to the housing.

Yet another object of the present invention is to provide a new and improved indexing mechanism having means for reinforcing rotation of a detent spring in response to rotation of the shaft.

Yet a further object of the present invention is to provide a stop element secured to the shaft of an indexing mechanism wherein a plurality of nubbins extending from the stop element engage nubbin receiving notches in a detent spring for reinforcing rotation of the detent spring in response to rotation of the shaft.

Further objects and advantages of the present invention will become apparent as the following description proceeds, and the features of novelty characterizing the invention will be pointed out with particularity in the claims annexed to and forming a part of this specification.

Briefly, the present invention is concerned with an indexing mechanism comprising a stamped hill and valley insert secured to a housing and a detent spring biased into engagement with the insert. A plurality of ears extending radially from the periphery of the insert and a pair of spaced arms extending perpendicularly from each of the ears engage ear receiving notches within the housing. The spaced arms are biased against the walls of the notches and rigidly secure the insert to the housing. The same housing can be used for different angles of indexing by merely changing the insert secured to the housing. A stop arm provided with a nubbin engaging a nubbin receiving notch provided in the detent spring constrains the detent spring to the stop arm and reinforces rotation of the detent spring in response to rotation by a shaft.

For a better understanding of the present invention, reference may be had to the accompanying drawings wherein the same reference numerals have been applied to like parts and wherein:

FIG. 1 is an isometric view of an indexing mechanism built in accord with the present invention and a switch wafer connected to the indexing mechanism;

FIG. 2 is a cross sectional view of the indexing mechanism taken along line II—II of FIG. 1;

FIG. 3 is an exploded view of the indexing mechanism and switch wafer shown in FIG. 1; and FIG. 4 is an isometric fragmentary view of a hill and valley insert secured to the housing shown in FIG. 1; and FIG. 5 is an enlarged fragmentary sectional view taken along line V—V of FIG. 2 and shows the engagement of the detent spring with the hill and valley insert.

Referring now to the drawings, there is illustrated an indexing mechanism generally indicated at 10 secured to a component requiring selective angular positioning such as a switch wafer 12. The indexing mechanism 10 comprises a die cast housing 14 of zinc or other suitable material, a stamped hill and valley insert 16 of stainless steel or other suitable material secured to the housing 14, a shaft 18 rotatably mounted by the housing 14, a stamped stainless steel detent spring 20 secured to the shaft 18, and a rear plate 22 fixedly attached to the housing 14 biasing the detent spring 20 into engagement with the hill and valley insert 16. Various angular positions are obtainable merely by changing the insert.

Considering first the housing 14, it comprises a back wall or plate 23 as best seen in FIG. 3 with a depending annular flange 24 supporting integral struts 26 for securing the switch wafer 12 to the housing 14. It should be understood that the annular flange 24 could be provided with holes and that the switch wafer 12 could be secured to the housing 14 by strut screws or other suitable fasteners. The annular flange 24 is provided with a plurality of lug receiving notches 30 and a plurality of ear receiving notches 32 defined by side walls 42 and 42*a*. An externally threaded bushing 28 secured to the plate 23 provides the means to secure the indexing mechanism 10 to a not shown mounting panel.

In accord with the present invention, the hill and valley insert 16 is a stamped annular ring provided with a peripheral edge 34 and a plurality of hills 35 and valleys 36 defining switching positions and angles of indexing. It should be understood that there can be any number of switching positions and angles of indexing for the selector switch by merely providing a suitable hill and valley insert and securing it to the housing 14 in the manner to be described. The peripheral edge 34 of the hill and valley insert 16 is disposed adjacent the edge of the annular flange 24 of the housing 14 and the annular flange 24 provides an enclosure for the hill and valley insert 16. The hill and valley insert 16 lies against the plate 23 of the housing 14 and the hills 35 and valleys 36 are concentrically disposed about an aperture 19 provided in the housing 14.

Preferably, three radially extending ears 38 lying in the plane of the hill and valley insert 16 are spaced along the peripheral edge 34 of the hill and valley insert 16. Each of the radially extending ears 38 extends into a respective ear receiving notch 32 in the housing 14. In accord with the present invention, integral with each of the radially extending ears 38 are a pair of spaced arms 40 and 40*a* extending perpendicularly from the ears 38 along the side walls 42 and 42*a* of each ear receiving notch 32. As best seen in FIG. 4, the spaced arms 40 and 40*a* are biased into engagement with the side walls 42 and 42*a* respectively of each ear receiving notch 32 providing a rigid and rotation free attachment of the hill and valley insert 16 to the housing 14. The hill and valley insert 16 does not rotate with respect to the housing 14 since the spaced arms 40 and 40*a* are flexed inwardly toward one another upon insertion into the ear receiving notches 32 creating a strong bias of the arms 40 and 40*a* outwardly against the walls 42 and 42*a* of the notch 32. This strong bias resists further inwardly flexing of the spaced arms 40 and 40*a* thereby preventing rotation of the hill and valley insert 16 with respect to the housing 14 upon rotation of the detent spring 20 in engagement with the hill and valley insert 16.

The detent spring 20 is provided with a flat center section 44 provided with a pair of nubbin receiving openings 46 and a center aperture 54. Integral with the flat center section 44 are a pair of spring sections 48 inclined with respect to the flat center section 44 and containing oppositely disposed spherical detents 50. A pair of cut outs 52 are provided in the detent spring 20 to improve the spring action of the detent spring 20. The shaft 18 is provided with a round portion 56 journaled in the aperture 19 in the housing 14 and a flat portion 57 extending through the center aperture 54 in the detent spring 20. The flat and round portions 56 and 57 of the shaft 18 define a shoulder 58 with the flat center section 44 of the detent spring 20 abutting the shoulder 58. The flat portion 57 of the shaft 18 engages the center aperture 54 of the detent spring 20 to constrain the detent spring 20 to rotate therewith.

In accord with the present invention, a stop element 60 provided with a center opening 62 abuts the detent spring 20. The flat portion 57 of the shaft 18 engages the center opening 62 in the stop element 60 to constrain the stop element 60 to rotate therewith, and the flat portion 57 is staked to the stop element 60 to secure the stop element 60 and the detent spring 20 against the shoulder 58 to prevent the axial movement thereof along the shaft. Integral with the stop element 60 are a stop member 64 inclined away from the detent spring 20 and a pair of nubbins 66 projecting from a surface of the stop element 60 and engaging the nubbin receiving openings 46 in the detent spring 20. The detent spring 20 will often slip with respect to the shaft 18 after a substantial number of rotations of the shaft. Therefore, with the nubbins 66 engaging the nubbin receiving openings 46, the rotation of the stop element 60 will reinforce the rotation of the detent plate 20 in response to the rotation of the shaft 18 preventing slipping of the detent spring 20.

The rear plate 22 is provided with a hole 68 for receiving the shaft 18 and a plurality of lugs 70 engaging the lug receiving notches 30 in the housing 14 to secure the rear plate 22 to the housing by staking or other suitable means. The attachment of the rear plate 22 to the housing 14 biases the spherical detents 50 into engagement with the hill and valley insert 16 as seen in FIGS. 2 and 5. With each of the spherical detents 50 biased into engagement with a respective valley 36 of the hill and valley insert 16, a predetermined torque is required to rotate the spherical detents 50 up over a respective hill 35 of the hill and valley insert 16 to an alternate position. An integral projection 72 on the rear plate 22 engages the stop member 64 to thereby halt rotation of the shaft 18.

From the foregoing, it is obvious that the indexing mechanism 10 can be easily assembled in production. The housing 14 is die cast with or without an integral bushing 28 or struts 26. A blanked hill and valley insert 16 providing a predetermined number of switch positions and angles of indexing is secured to the housing 14 by inserting the radially extending ears 38 and spaced arms 40 and 40*a* into the ear receiving notches 32 with the housing 14. A shaft subassembly comprising the detent spring 20 and the stop element 60 secured to the shaft 18 is then inserted in the aperture 19 provided in the housing 14 and a rear plate 22 is secured to the housing 14 biasing the detent spring 20 into engagement with the hill and valley insert 16.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by letters patent of the United States is:

1. An indexing mechanism comprising a front plate with an annular flange, said flange being provided with a plurality of lug receiving notches and a plurality of ear receiving notches, a hill and valley insert disposed against the front plate, a plurality of ears extending radially from the insert, a pair of spaced arms perpendicularly extending from each of said ears, each of said ears and spaced arms engaging a respective one of said ear receiving notches and securing the hill and valley insert to the front plate, a rear plate having a plurality of lugs, each of the lugs engaging a respective one of said lug receiving notches and aligning the rear plate to the front plate, a shaft rotatably supported by the front plate, a detent spring biased between the front and rear plates and constrained to rotate with the shaft, said detent spring having at least one nubbin receiving opening, a spherical detent integral with the detent spring and engaging the hill and valley insert, a stop element constrained to rotate with the shaft, a nubbin projecting from the stop element and engaging the nubbin receiving opening of the detent spring, the nubbin reinforcing movement of the detent spring during rotation of the shaft and a stop projection integral with the rear plate, said stop element engageable with the stop projection for halting rotation of the shaft.

2. The indexing mechanism of claim 1, wherein each of said ear receiving notches is defined by a wall and each of the spaced arms is biased into engagement with the wall of the respective ear receiving notch.

3. An indexing mechanism comprising a first plate and a second plate in spaced parallel relationship, an annular flange integral with one of the plates, the other of the plates being secured to the flange, the first and second plates and the flange defining a housing, a shaft rotatably supported by the housing, a hill and valley insert member mounted between said first and second plates, and a detent spring member biased into engagement with the hill and valley insert member, one of said members being constrained to rotate with the shaft, one of said members being biased against the first plate and the other of said members being interlocked with the second plate.

4. The mechanism of claim 3, wherein a radially extending ear is integral with the hill and valley insert, and the flange is provided with a notch defined by a wall, said ear engaging the notch.

5. The indexing mechanism of claim 4, wherein a first arm is integral with the radially extending ear and is biased into engagement with the wall of said notch.

6. The indexing mechanism of claim 5, wherein a second arm is integral with the radially extending ear and is disposed opposite to the first arm, said second arm being biased into engagement with the wall of said notch in a direction opposite the bias of said first arm.

7. The mechanism of claim 3, wherein the flange integral with one of the plates is of die cast material, and the hill and valley insert is of stainless steel.

8. The mechanism of claim 3, wherein the hill and valley insert is an annular ring having a peripheral edge disposed adjacent to and having a diameter less than the inner diameter of said flange, and wherein said hill and valley insert member is interlocked with the second plate having the flange integral therewith.

9. The indexing mechanism of claim 3 including reinforcement means secured to the shaft, said reinforcement means engaging the detent spring to reinforce the movement of the detent spring in response to the rotation of the shaft.

10. In an indexing mechanism for a selector switch, the combination of a housing providing a predetermined number of hills and valleys, a shaft rotatably supported by the housing and disposed in concentric relationship with respect to the hills and valleys, a detent spring means constrained to rotate with the shaft, a plate secured to the housing for biasing the detent spring means into engagement with the hills and valleys of the housing, and a detent spring reinforcement means secured to the shaft, said reinforcement means engaging the detent spring means to reinforce the movement of the detent spring means in response to the rotation of the shaft, a nubbin on one of the means, the other of the means being provided with an opening receiving the nubbin whereby the two means are constrained to rotate with each other.

11. The mechanism of claim 10, wherein the detent spring reinforcement means is a stop element containing a radially extending stop member and the plate contains a projection, said stop member engaging the projection to halt rotation of the shaft.

12. The indexing mechanism of claim 10, wherein the hills and valleys are provided on a stainless steel member inserted in the housing.

* * * * *